United States Patent [19]

Davis et al.

[11] Patent Number: 4,541,536

[45] Date of Patent: Sep. 17, 1985

[54] TAMPER-RESISTANT CONTAINER ASSEMBLY

[75] Inventors: Eugene E. Davis, Ilford; Richard J. Searle, London, both of England

[73] Assignee: Johnsen & Jorgensen (Plastics) Ltd., England

[21] Appl. No.: 603,192

[22] Filed: Apr. 23, 1984

[30] Foreign Application Priority Data

Jul. 15, 1983 [GB] United Kingdom ..... 8319263

[51] Int. Cl.[4] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 3,980,195 | 9/1976 | Fillmore | 215/252 |
| 4,225,050 | 9/1980 | Reinhart | 215/252 |
| 4,461,391 | 7/1984 | Davis | 215/252 |

*Primary Examiner*—Donald F. Norton

*Attorney, Agent, or Firm*—F. Eugene Davis, IV

[57] ABSTRACT

A tamper-resistant screw cap and container body assembly has a cap which is connected to a safety band which can turn with the cap when the cap is being screwed on to the container body but which is held against turning when the cap is being screwed off, by the engagement of discontinuous ratchet-shaped inner beads on the cap with discontinuous ratchet-shaped outer beads on the container body beneath a continuous outer retaining bead.

5 Claims, 5 Drawing Figures

TAMPER-RESISTANT CONTAINER ASSEMBLY

This invention is concerned with the provision of a tamper-resistant container assembly comprising a container body and a closure adapted for screw-threaded engagement with the body.

Tamper-resistant containers have been known for some years. One form of tamper-resistant container has made use of a container body with a continuous annular bead around the outside of the neck and a closure including a safety band with a continuous annular bead on the inside. The body had an external screw thread around the neck and the closure had an internal screw thread to engage with the screw thread on the body.

In addition the container was provided with ratchet means to assist in screwing the closure onto the body without breaking the connection between the safety band and the rest of the closure, the ratchet means being so arranged that when the closure was in operative position on the container body the ratchet mechanism was above the continuous bead on the body.

Up to a point the above described known form of tamper-resistant container has proved to be effective but experience has shown that it is sometimes possible to remove the closure without breaking the tell-tale connection between the closure and the safety band.

Our experiments have shown that this difficulty is due to the fact that the safety band can be made to rotate with the closure not only when screwing the closure on but also when unscrewing it. In order to make it more difficult for the closure to be removed in an unauthorised way, attempts have been made to make the closure a tighter fit on the body but that is an unsatisfactory solution to the problem because it becomes so difficult to apply the closure to the body that the safety band or the tell-tale connections tended to break as the bead on the closure was pressed over the head on the body.

According to the present invention there is provided a tamper-resistant container assembly comprising a closure and a body wherein the closure has a top, a depending skirt with an internal screw thread, teeth at the lower edge of the skirt, a safety band below the skirt, frangible tell-tale means connecting the skirt to the safety band, teeth on the upper edge of the safety band and a plurality of discontinuous inner beads on the safety band and wherein the container body has a mouth, a neck below the mouth, an external screw thread on the neck, a continuous outer bead below the thread and a plurality of discontinuous outer beads below the continuous outer bead characterised in that the inner beads cooperate with the outer beads to restrain the safety band against angular movements when the closure is being unscrewed.

Figure 1:
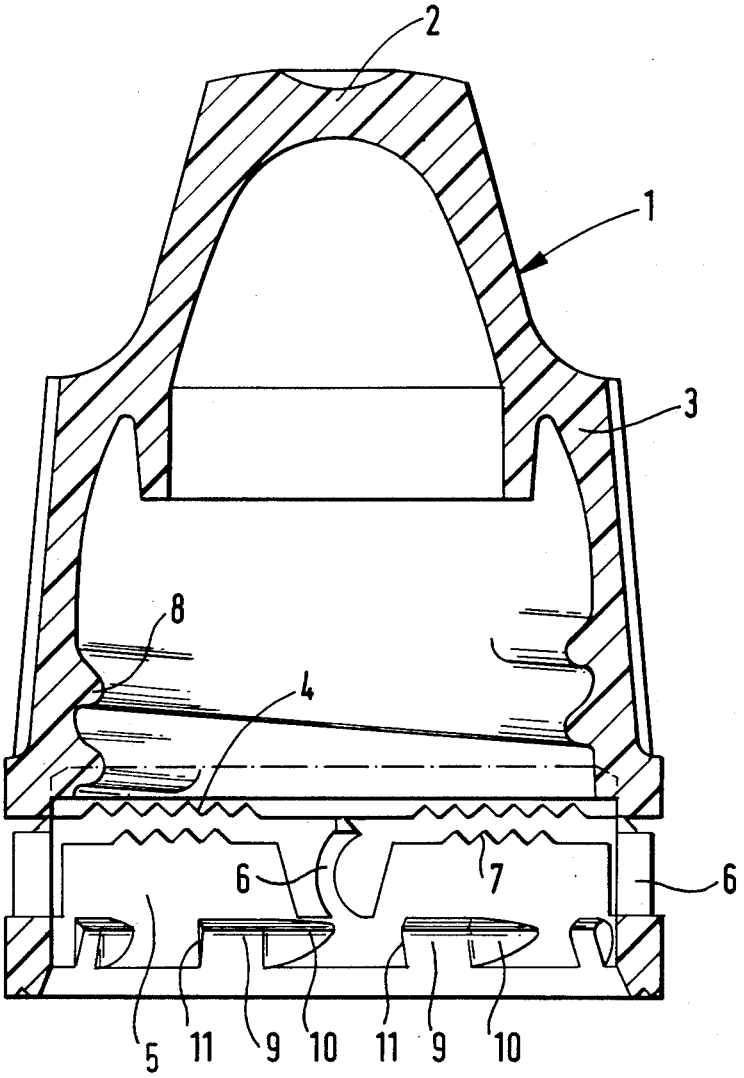
Figure 2:
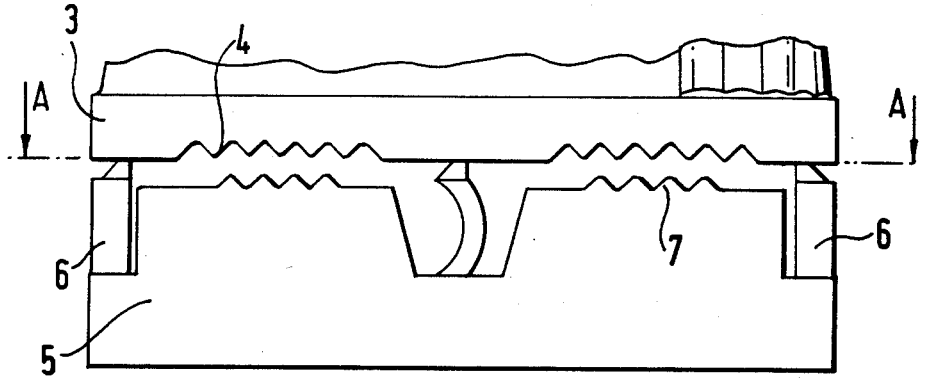
Figure 3:
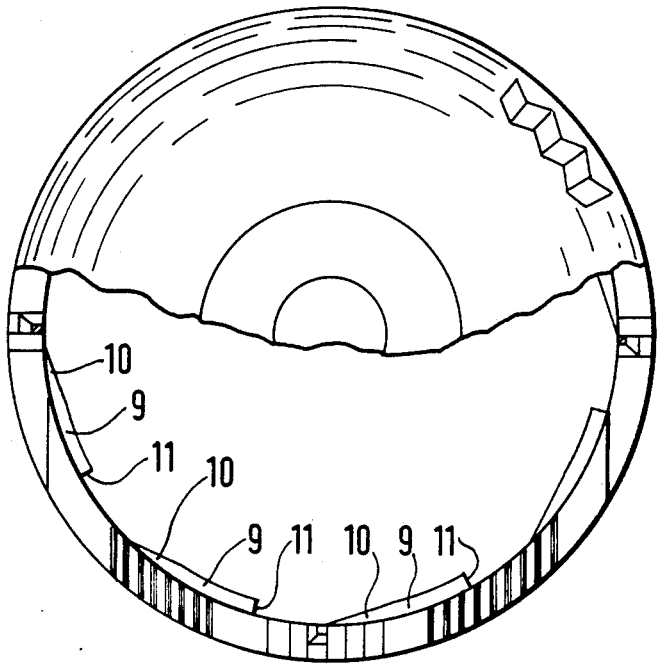
Figure 4:
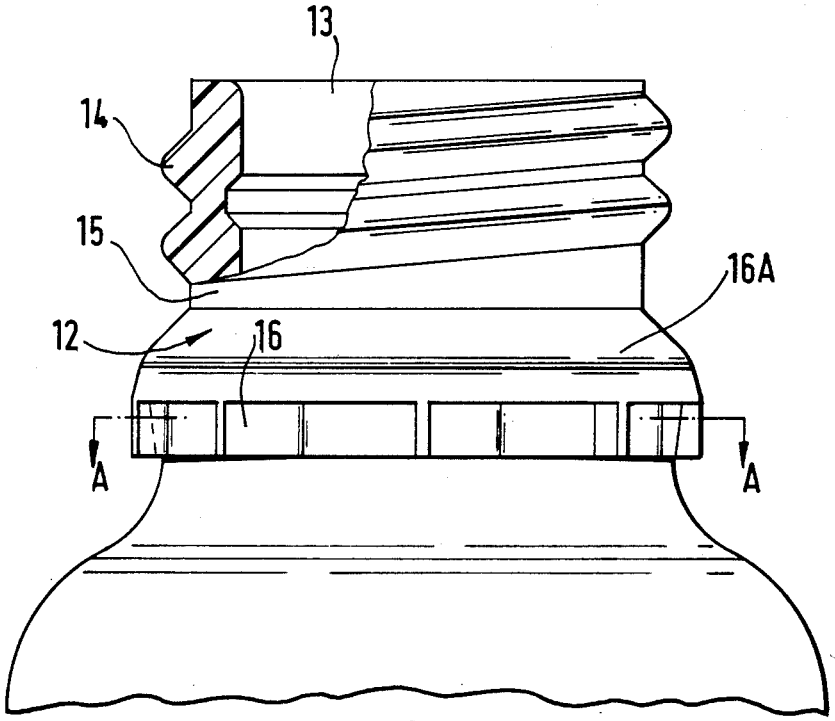
Figure 5:
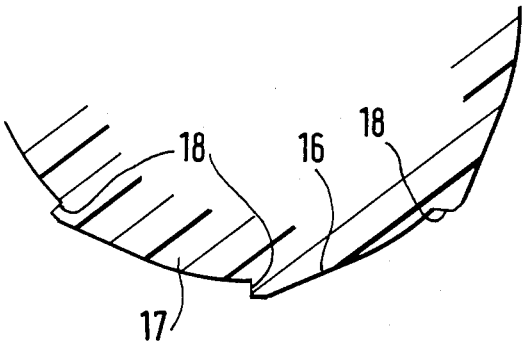

In order that the invention may be more clearly understood reference is now directed to the accompanying drawings given by way of example in which:

FIG. 1 is a longitudinal sectional view of a closure for use in an assembly according to the invention, FIG. 2 is a detail view of the closure, FIG. 3 is a section on the line A—A of FIG. 2, FIG. 4 is a part side view of a container body for use in an assembly according to the invention, and FIG. 5 is a part section on the line A—A of FIG. 4.

Referring to FIG. 1 a closure 1 has a top 2, a depending skirt 3, teeth 4 at the lower edge of the skirt, a safety band 5, frangible tongues 6 connecting the band 5 to the skirt 3, teeth 7 at the upper edge of the band and an internal screw thread 8. The band has a plurality of internal discontinuous ratchet-shaped beads 9 each of which has a lead-in ramp 10 and an abrupt shoulder or stop 11 at the other end. In this embodiment there are eight beads 9 but it will be understood that any desired and convenient number of beads 9 may be used.

Referring now to FIGS. 4 and 5 a container body 12 has a mouth 13, an external screw thread 14, a neck 15, a continuous bead 16A and a plurality of external discontinuous ratchet shaped beads 16, below the normal continuous bead. Each of the beads 16 has a lead-in ramp 17 and an abrupt shoulder or stop 18 facing in a direction opposite to stop 11 on the beads 9.

In operation when the closure 1 is being screwed onto the container body 12 the safety band 5 turns with the skirt 3 due to the engagement of the teeth 4 with the teeth 7, the skirt 3 being urged downwardly by torque applied to the closure 1. When the beads 9 have passed over the continuous bead 16A and meet the beads 16, the lead-in ramps 10 and 17 meet and the beads 9 slide over the beads 16 until the closure has reached its fully-on position. This provision of the lead-in ramps 10 and 17 substantially reduces the torque required to screw the closure 1 onto its final position because each bead has only one high point, at the shoulder end, so that in this embodiment there are only eight high spots on the closure instead of what amounts to a continuous high spot as in the past which was a major constraint.

In effect the eight shaped beads in this example convert the continuous circular beads into octagons which are self-adjusting.

It is an important feature of this invention that the discontinuous beads 16 are under the normal bead 16A on the container body. If we put our ratchet ring of beads 16 above the normal bead, unscrewing of the closure with the body subsequently tilted for pouring could cause the safety band to fall off into a receptacle or, in this case, the user's eye. Further than that, in such a construction the safety ring can be retained by an unscrupulous person and wedged back into position by the screw cap so that an authorised user may not notice that the band has been broken. In our case the band simply falls down onto the shoulder or step of the container body and is immediately tamper evident.

When the closure is turned to unscrw it the stops or shoulders 11 abut against the stops or shoulders 18 so that the safety band does not turn with the skirt, the upper part of the closure rises and the tongues 6 break giving evidence that the container has been opened.

It will be understood that the container illustrated is an eye-dropper, given by way of example, and that the outside shape of the container below the neck form described forms no part of the present invention.

We have therefore provided a tamper-resistant screw cap and container body assembly wherein the cap is connected to a safety band which can turn with the cap when the cap is being screwed on but which is held against turning when the cap is being screwed off. The invention also includes a cap and a body for use in the assembly.

We claim:

1. A tamper-resistant screw cap and container body assembly wherein the cap is connected to a safety band which can turn with the cap when the cap is being screwed on to the container body but which is held against turning when the cap is being screwed off, by the engagement of discontinuous ratchet-shaped inner beads on the cap with discontinuous ratchet-shaped outer beads on the container body; and wherein said container body comprises an annular bead, and the innermost portions of said outer beads on said container body are underneath and inside of the outermost portion of said annular bead, and the innermost portions of said inner beads on said cap, when it is engaged, are also underneath and inside of the outermost portion of said annular bead.

2. A tamper-resistant container assembly comprising a closure and a container body wherein the closure has a top, a depending skirt with an internal screw thread, teeth at the lower edge of the skirt, a safety band below the skirt, frangible tell-tale means connecting the skirt to the saftey band, teeth on the upper edge of the safety band and a plurality of discontinuous inner beads on the safety band and wherein the container body has a mouth, a neck below the mouth, an external screw thread on the neck, a continuous outer bead below the thread and a plurality of discontinuous outer beads below the continuous outer bead, characterised in that the inner beads cooperate with the outer beads like a ratchet mechanism to restrain the safety band against angular movement when the closure is being unscrewed, and said innermost portions of said inner beads are disposed underneath and inside of the outermost portion of said continuous outer bead when said closure and body are engaged.

3. A tamper-resistant container assembly according to claim 2 characterised in that the discontinuous inner beads are of ratchet shape each bead having a lead-in ramp at one end and an abrupt shoulder or stop at the other end.

4. A tamper-resistant container assembly according to claim 3 characterised in that the discontinuous outer beads are also of ratchet shape each bead having a lead-in ramp and an abrupt shoulder or stop facing in a direction opposite to the stop on the inner beads.

5. A tamper-resistant container assembly having a substantially smooth unstepped outer profile comprising a closure and a container body wherein the closure has a cap part, a depending skirt with an internal screw thread, teeth at the lower edge of the skirt, a safety band below the skirt, frangible tell-tale means connecting the skirt to the safety band, teeth on the upper edge of the safety band and a plurality of discontinuous ratchet shaped inner beads on the safety band and wherein the container body has a mouth, a neck below the mouth, an external screw thread on the neck, and a continuous outer bead below the screw thread and a plurality of discontinuous ratchet shaped outer beads below the continuous outer bead; wherein the innermost portions of said outer beads and the outermost portions of said inner beads are disposed below said continuous outer bead and inside its largest periphery when said closure is engaged on said container body; the arrangement being such that (a) the closure can be applied to the container body for the first time simply by screwing the closure on, the safety band being driven on with the cap part by engagement of the teeth on the cap part with the teeth on the safety band, (b) the closure can be removed from the container body for the first time simply by screwing the closure off, the safety band being prevented from turning with the cap part by positive engagement of the discontinuous ratchet shaped beads on the band with the discontinuous ratchet shaped beads on the container body so that the frangible tell-tale means break, and (c) due to the fact that the discontinuous outer ratchet shaped beads on the container body are below and inside the perephery of the the continuous bead, the safety band can fall to the lower part of the container neck to give evidence that the closure may have been removed from the container body but cannot fall off of the container when the cap part is removed.

* * * * *